US006672456B2

(12) United States Patent
Russell

(10) Patent No.: US 6,672,456 B2
(45) Date of Patent: Jan. 6, 2004

(54) FLEXIBLE PACKAGING FILM POUCH WITH INTERNAL STIFFENER TO CREATE AN ANTI-PILFERING PACKAGE

(75) Inventor: Paul Grady Russell, Campbell, CA (US)

(73) Assignee: Hewlett-Packard Delevopment Company, LP., Houston, TX (US)

( * ) Notice: Subject to any disclaimer, the term of this patent is extended or adjusted under 35 U.S.C. 154(b) by 0 days.

(21) Appl. No.: 09/882,097

(22) Filed: Jun. 14, 2001

(65) Prior Publication Data

US 2002/0189203 A1 Dec. 19, 2002

(51) Int. Cl.[7] ..... B65D 73/00
(52) U.S. Cl. ..... 206/460; 206/466; 206/497
(58) Field of Search ..... 206/460, 526, 206/461, 497, 459.5, 813, 432, 466, 471, 807

(56) References Cited

U.S. PATENT DOCUMENTS 3,675,767 A * 7/1972 Taylor ..... 206/497
4,953,702 A * 9/1990 Bryan ..... 206/432
5,228,564 A * 7/1993 Randeria ..... 206/497
5,350,059 A * 9/1994 Chester et al. ..... 206/460
5,887,717 A * 3/1999 Anderson et al. ..... 206/460
5,893,459 A * 4/1999 Croft ..... 206/460

* cited by examiner

*Primary Examiner*—Luan K. Bui

(57) ABSTRACT

A product packaging system and method. In one embodiment, the present invention is comprised of a backing member to which a product will be adhereingly disposed thereon. The packaging system is further comprised of an adhering material disposed upon the backing material for adhering the product to the backing member. The packaging system is further comprised of a flexible plastic material for encasing the backing member with the product adhereingly attached thereto. The flexible plastic material is sealable and tear resistant. The present invention is further comprised of a sealing component for sealing the flexible plastic material, such that the product and the backing member to which the product is disposed thereon are packaged. In one embodiment, the backing member is relatively rigid in nature and readily recyclable. In one embodiment, the flexible plastic is adapted to receive marketing communication materials and graphics/artwork.

8 Claims, 15 Drawing Sheets

2001

FLEXIBLE PACKAGING FILM POUCH WITH INTERNAL STIFFENER TO CREATE AN ANTI-PILFERING PACKAGE

FIELD OF THE INVENTION

The present invention relates to product packaging. More particularly, the present invention provides a system for packaging a product in a pliable pouch which includes a bracing portion so as create a theft deterring package.

BACKGROUND OF THE INVENTION

In retail and wholesale stores and outlets, the consumer is presented with a nearly endless variety and selection of products for purchase. These products available for purchase range anywhere from sporting goods to household appliances, large and small, from collectibles to electronic devices. One aspect of almost all products available to a consumer is that nearly every product comes in some sort of packaging. There are nearly as many different package compositions and designs as there are products to package. For example, one product may come in a square cellophane or plastic wrapper while another product may come in a round paperboard box.

Another frequently used packaging system is the plastic clamshell. The plastic clamshell is commonly constructed out of thermo-formed PVC (polyvinyl chloride) or other hard plastic material. The shape and form of the plastic clamshell is dictated, in part, by the physical structure of the product to be packaged. Accordingly, a master blank or template is designed for each product that is to be packaged. Then the mechanism that provides the thermo-formed plastic packaging is retooled for that specific design run. When another product is to be packaged, the above process is repeated, which adds to the cost of the product.

FIG. 1 is a side angled perspective view of an exemplary prior art plastic clamshell package 10. Plastic clamshell package 10 has two halves, a front half 2 and a back half 3, which are then sealed around the product 1, thereby encasing the product which, in this example, is a set of headphones. The dotted line within plastic clamshell 10 represents the portions of front half 2 and back half 3 that will be melded together when sealed. The clear plastic enables the product, in this instance, the headphones, to be viewed by the consumer while being displayed at the place of purchase while also protecting the product from damage during transportation and also. Additionally, the plastic clamshell is normally much larger that the product it is encasing, as is shown in FIG. 1. This provides a measure of anti-theft protection because of the difficulty of concealment of a large and uneven package. This theft reducing trait is especially advantageous in large retail outlets and warehouse type or club membership stores or outlets.

However, the plastic clamshell is not without drawbacks. One drawback of the plastic clamshell is that it is usually quite difficult to open. While the rigidity of the plastic protects the product, it is the rigidity combined with the heat sealing process of the clamshell that prevents a consumer from easily opening the package. A sturdy pair of scissors or a large knife are but two of the implements commonly used to open the package, and given the force necessary to open the package, a consumer could conceivably injure themselves while attempting to open the clamshell package.

An additional drawback to the plastic clamshell packaging is that while the material is clear, thereby enabling a consumer to view the product, the surface is not well suited for any effective graphics to be printed thereon. As such, an alternative media for the desired effective graphics would need to be provided, which adds to the overall cost of the product, ultimately increasing the purchase price of the product.

Another drawback of the plastic clamshell is in shipping of the product. Because of the uneven or unsmooth shape and form of the plastic clamshell, extra shipping space is needed to compensate for the lack of stackability. For example, a greater number of evenly smooth shaped packages will fit within a defined space more easily than will odd-shaped, uneven, and unsmooth packages. Accordingly, this increase in shipping costs is also passed on to the consumer, increasing the overall cost of the product.

An additional drawback to the plastic clamshell is that once the package is opened and the product removed, there is the matter of disposal. As stated above, because of the rigidity of the plastic clamshell, it is not easily compressed or collapsed, and as such, can take up more home trash can space, and eventually use more space at a landfill than does a more easily collapsed or compressed package. Further, the materials used in the manufacturing of the plastic clamshell, such as e.g., PVC (polyvinyl chloride), are not being accepted by many of the curbside collection recycling centers. This can cause consumers to have environmental concerns regarding this type of packaging, such that they may forego the purchase of one product in light of a similar product in a more readily recyclable or disposable package.

SUMMARY OF THE INVENTION

Thus a need exists for a product packaging system and method which provides packaging of products in a flexible but sealable and tear resistant package. Another need exists for a packaging system which provides product protection from incidental damage while providing a measure of theft protection. An additional need exists for a packaging system which reduces solid waste and which is readily recyclable. A further need exists for a packaging system which is able to utilize marketing communication materials and graphics/artwork.

Accordingly, the present invention provides a packaging system and method. In one embodiment, the present invention is comprised of a backing member to which a product will be adhereingly disposed thereon. The packaging system is further comprised of an adhering material disposed upon the backing material for adhering the product to the backing member. The packaging system is further comprised of a flexible plastic material for encasing the backing member with the product adhereingly attached thereto. In the present embodiment, the flexible plastic material is sealable and tear resistant. The present invention is further comprised of a sealing component for sealing the flexible plastic material, such that the product and the backing member to which the product is disposed thereon are packaged. In one embodiment, the backing member is relatively rigid in nature and readily recyclable. In one embodiment, the flexible plastic is adapted to receive marketing communication materials and graphics/artwork.

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION

A packaging system and method are described. In the following description, for purposes of explanation, numerous specific details are set forth in order to provide a thorough understanding of the present invention. It will be obvious, however, to one skilled in the art that the present invention may be practiced without these specific details. In other instances, well-known structures and devices are shown in block diagram form in order to avoid obscuring the present invention.

Notation and Nomenclature

Some portions of the detailed description, which follow, are presented in terms of procedures, steps, processes, and other symbolic representations of operations performed on items/products to be packaged. These descriptions and representations are the means used by those skilled in the product packaging arts to most effectively convey the substance of their work to others skilled in the art. A procedure, process, step, etc., is here, and generally, conceived to be a self-consistent sequence of steps or processes which leads to a desired result.

It should be appreciated that many of the steps and processes described, which follow, are performed by a form-fill-seal packaging apparatus, which provides the means to accomplish the steps, procedures, and processes required in product packaging. One such packaging apparatus commercially and readily available today is from Mahaffy & Harder Engineering Company of Fairfield, N.J., USA. Another such packaging apparatus is available from Rovema Packaging Machines of Lawrenceville, Ga., USA. Yet another such packaging apparatus is available from Iman Pack Sigma System Incorporated of Westland, Miss., USA. It should be appreciated that nearly any packaging apparatus may be used in conjunction with the present invention, provided the packaging apparatus includes forming, filling, sealing, and pre-shipping functionalities.

The present invention is discussed primarily in the context of the packaging of small products, such as those found in electronic and computer industries. However, it is appreciated that the present invention can be used with other larger sized products, which may or may not be necessarily drawn to computer or electronic industries. It is further appreciated that the present invention can be used with nearly any product or item which is deemed needing packaging by manufacturers and/or retail/wholesale stores, but should not be limited solely to small products that are associated with the computer or electronic industries.

Figure 1:
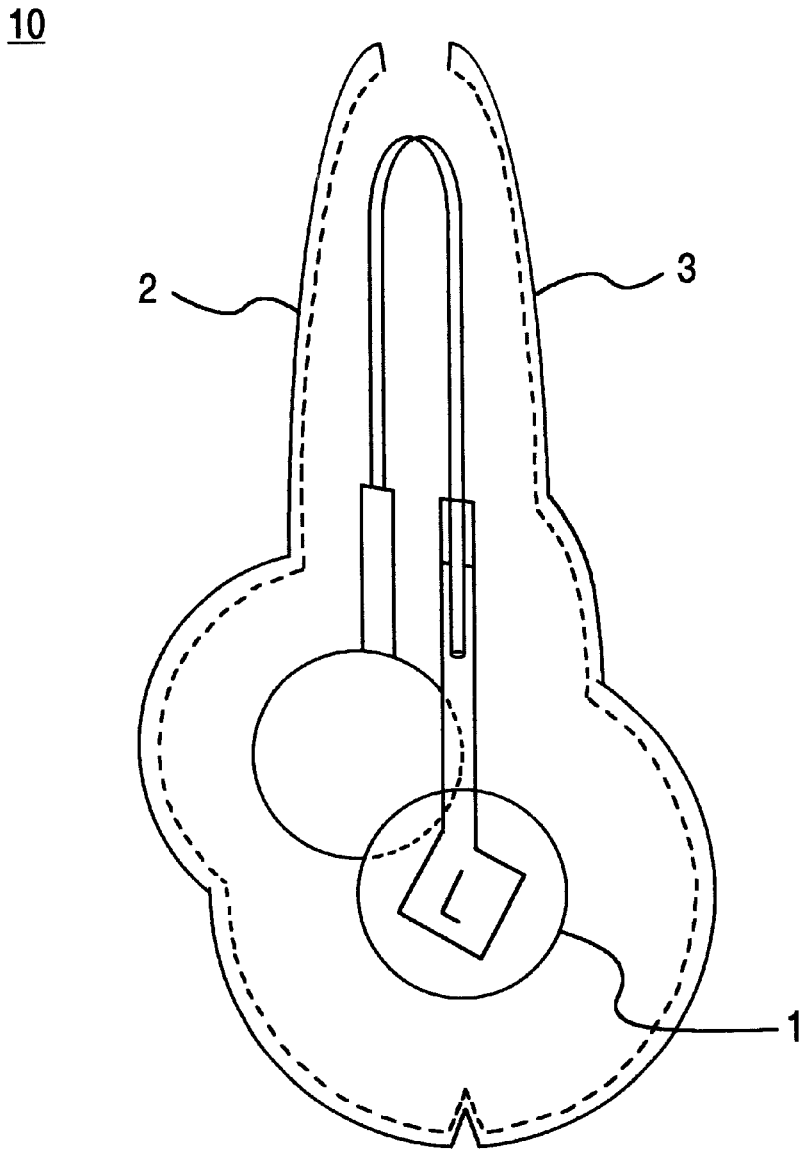
Figure 1 (Prior Art)
FIG. 1 is a side angled perspective view of an exemplary prior art plastic clamshell.
Figure 2A:
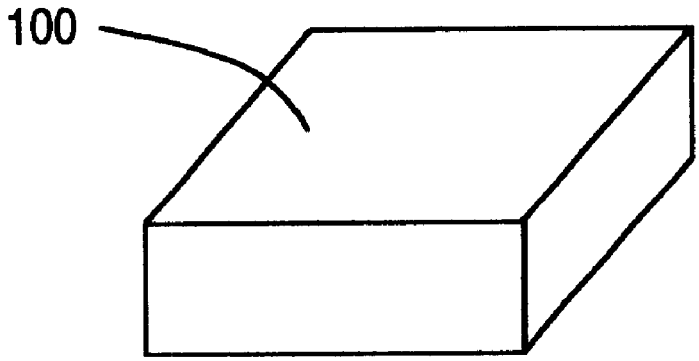
FIG. 2A is an illustrated view of a product which is to be packaged, in accordance with one embodiment of the present invention.

FIG. 2A is an illustrated side view of a product 100 to be packaged, in one embodiment of the present invention. Product 100 can be nearly any product available to a consumer. In this example, product 100 is rectangular in shape, although it may be almost any shape. In one embodiment, product 100 is a replacement ink cartridge for an inkjet printer and, to prevent premature drying of the ink contained therein, will be individually wrapped before packaging.

Figure 2B:
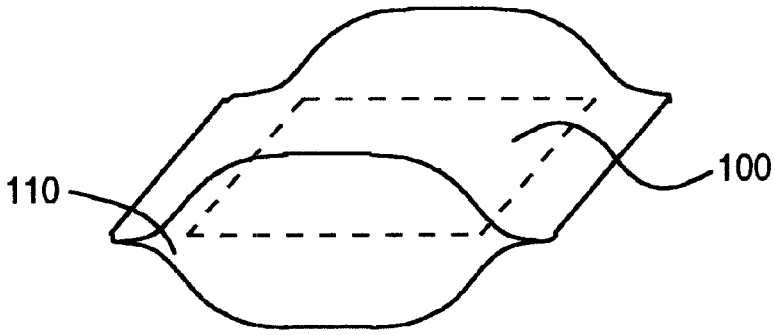
FIG. 2B is an illustrated view of the product in FIG. 2A having been pre-wrapped, in accordance with one embodiment of the present invention.

FIG. 2B is a sequential illustrated side view of product 100 of FIG. 2A having been individually wrapped in wrapper 110. It should be appreciated that a product may or may not need to be individually wrapped before packaging, as described above. The manufacturer of the product and/or the product reseller should determine whether the product would be better served if pre-wrapped. However, it should be appreciated that the present invention will work equally well with products that are pre-wrapped or are not pre-wrapped.

Figure 2C:
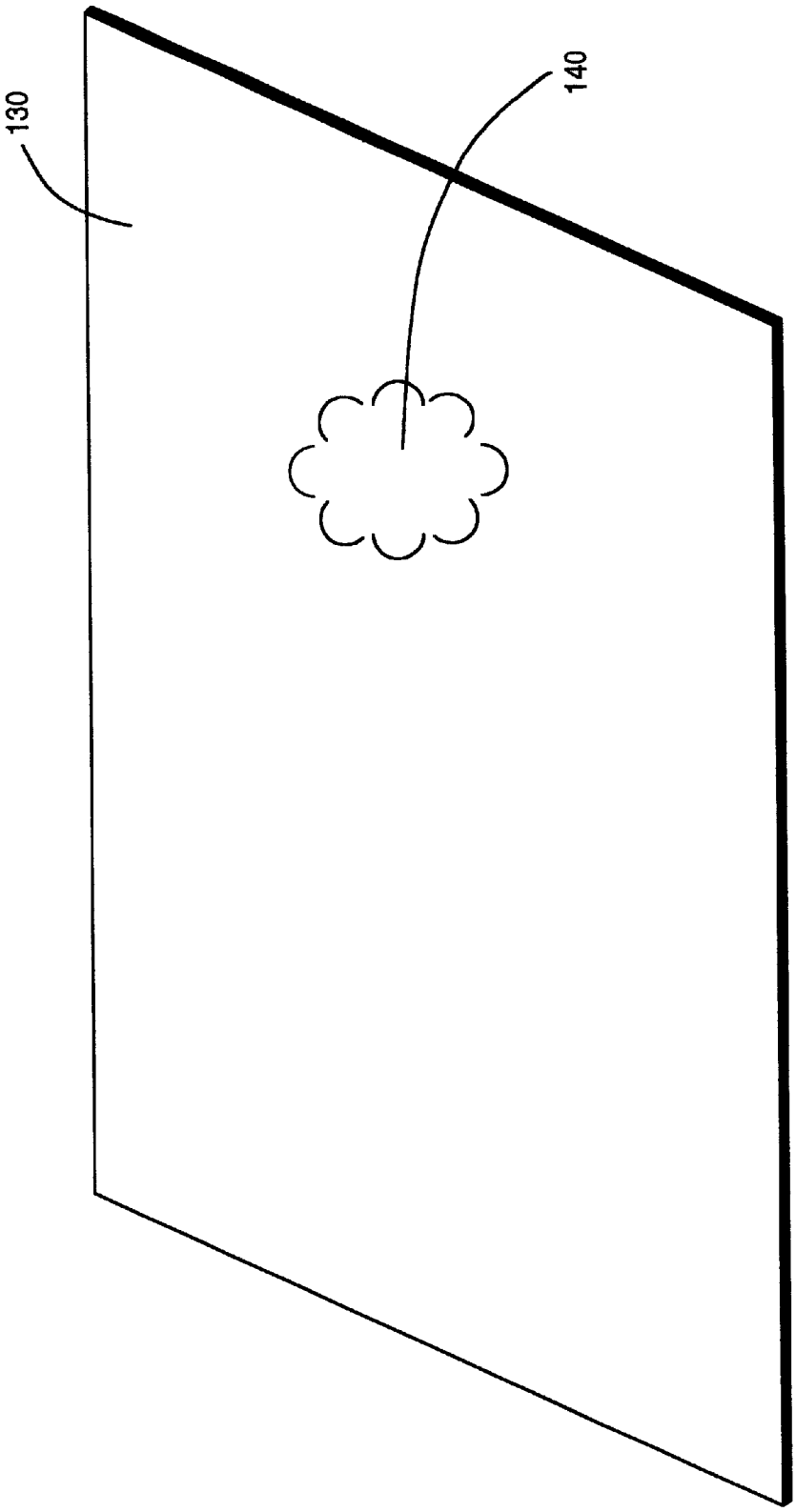
FIG. 2C is an illustrated view of a backing member having an adhesive disposed thereon, in accordance with one embodiment of the present invention.

FIG. 2C is an illustrated side view perspective of a backing member 130 upon which wrapper 110, containing product 100, will be disposed, in one embodiment of the present invention. Backing member 130 is shown in a horizontal orientation. Adhering material 140 is shown as disposed upon backing member 130 and is for adhering product 100, whether in wrapper 110 or not, to backing member 130. When product 100 is properly disposed upon backing member 130, adhering material 140 is interposed between product 100 and backing member 130.

In one embodiment, adhering material 140 is a hot-melted adhering material. When hot-melted adhering material 140 is applied to backing member 140, it is necessary for wrapper 110, containing product 100, to be placed on adhering material 140 during or immediately subsequent to the application of the adhering material. It should be appreciated that if a delay in placing wrapper 110, containing product 100, upon adhering material 140, occurs, there is the risk that adhering material 140 may harden to the point that the adhesive properties of adhering material 140 may no longer be present.

Still referring to FIG. 2C, in another embodiment of the present invention, adhering material 140 may be a non-permanent glue, such as a non-permanent glue which is found to be commonly used for attaching an insert, such as a perfume sample, to a page of a magazine or other periodical. Non-permanent glue provides adhesive properties without becoming bonded to the material or to the item onto which it is placed. The use of non-permanent glue to adhere wrapper 110, containing product 100, could lessen the need for immediate placement as is necessary with the hot-melted adhering material as mentioned above. Further, by utilizing a non-permanent glue in adhering material 140, the possibility of damage to product 100, wrapper 110, and backing member 130 during adhesive material removal is substantially reduced.

Although this disclosure depicts two examples of adhering materials, a hot-melted adhering material and a non-permanent adhering material, which are shown as implemented in FIGS. 2C, 2D, and FIGS. 3C and 3D which follow, it should be appreciated that nearly any material having adhesive properties may be implemented in the present invention. For example, a double sided tape having adhesive properties on both sides may be utilized. In another example, a well known and fast setting on contact adhesive, cyanoacrylate, commonly known as super glue, may be utilized.

Figure 2D:
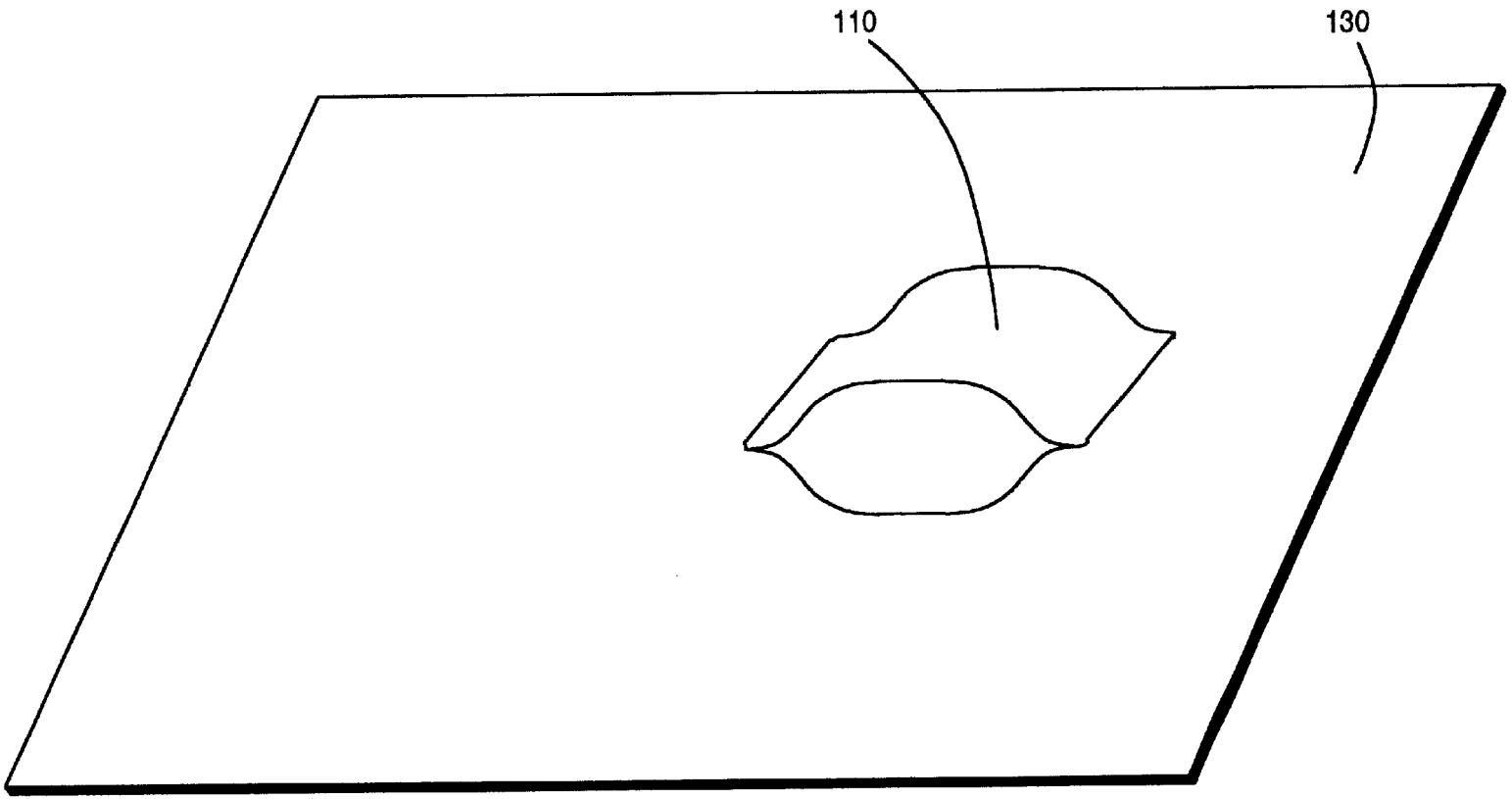
FIG. 2D is an illustrated view of the product in FIG. 2B disposed upon the backing member of FIG. 2C, in accordance with one embodiment of the present invention.
Figure 4A:
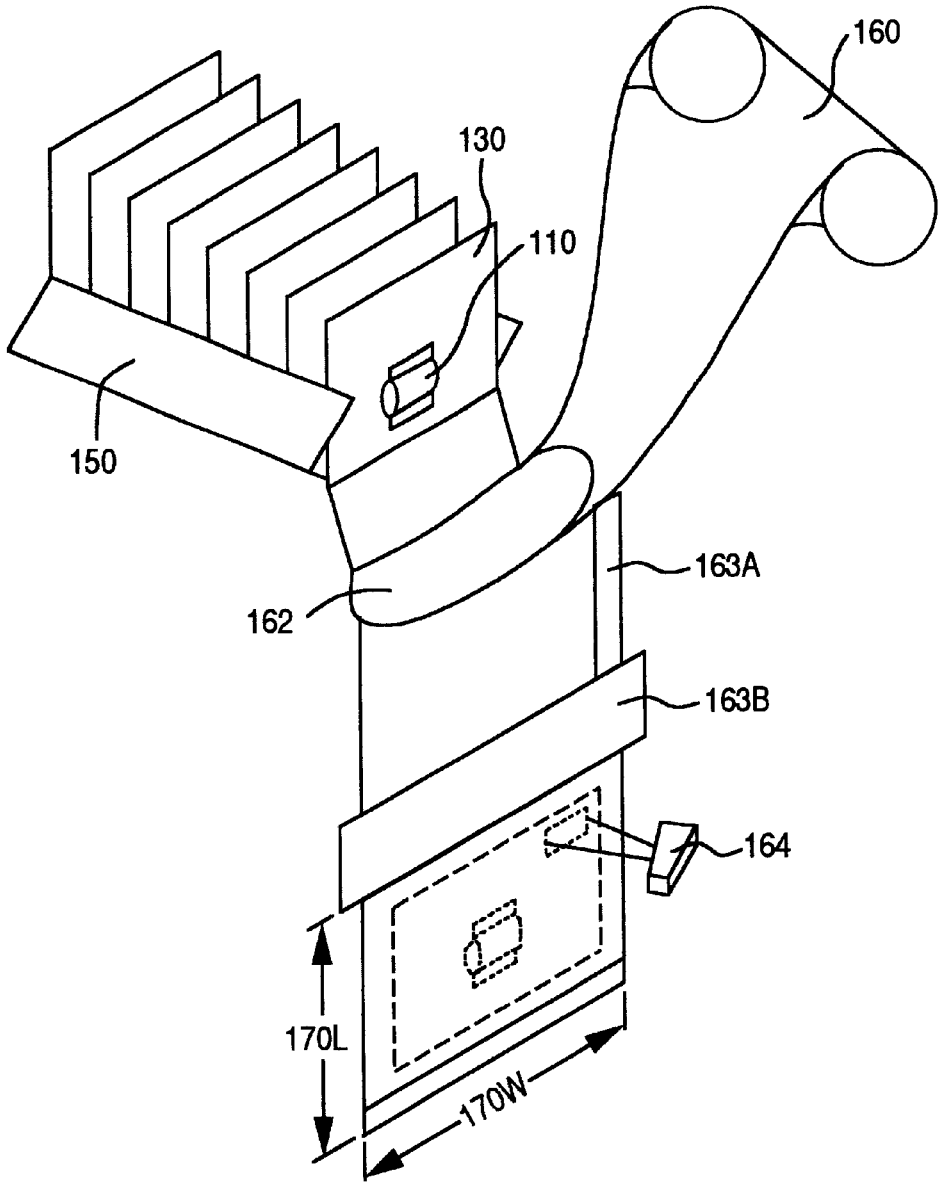
FIG. 4A is an illustrated view of the product and backing member of FIGS. 2D and 3D disposed within a loading magazine component for packaging thereof, in accordance with one embodiment of the present invention.

FIG. 2D is a sequential illustrated side view of wrapper 110, containing product 100, as having been properly disposed upon backing member 130, such that adhering material 140 is interposed between product 100 and backing member 130. After the proper placing of product 100, with or without wrapper 110, upon backing member 130, with product 100 being adhesively attached, backing member 130 is then placed into a loading magazine 150, as seen in FIG. 4A, in preparation for packaging, in accordance with one embodiment of the present invention.

Figure 3A:
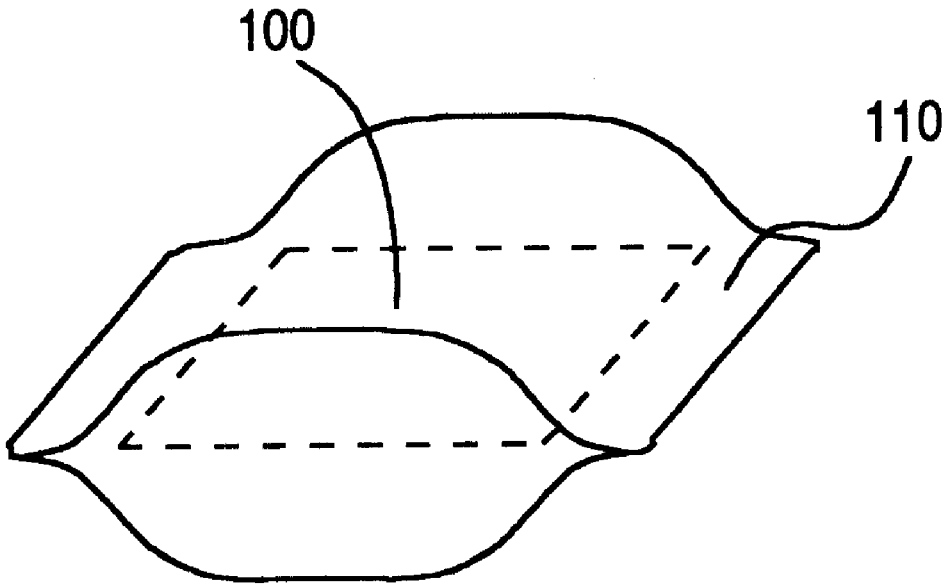
FIG. 3A is an illustrated view of the product of FIG. 2B.
Figure 3B:
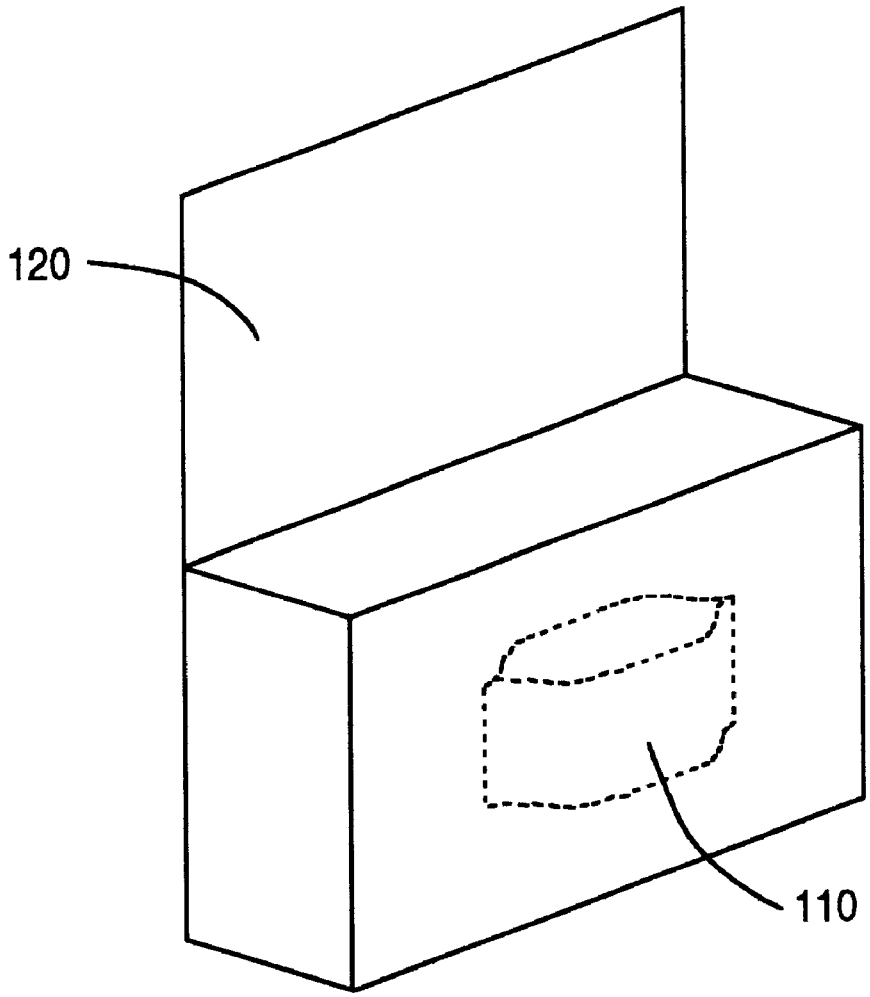
FIG. 3B is an illustrated view of the product in FIG. 3A having been pre-boxed, in accordance with one embodiment of the present invention.

FIG. 3A is an illustrated side view of wrapper 110, containing product 100, of FIGS. 2A and 2B, to be disposed within boxing 120 of FIG. 3B in preparation to being packaged, in one embodiment of the present invention. In this example of the present embodiment, product 100 is analogous to product 100 as described in FIGS. 2A–2D. As described in FIGS. 2A and 2B, product 100 is a replacement ink cartridge for an inkjet printer, and to prevent premature drying of the ink contained therein, will be individually wrapped in wrapper 110. However, before packaging, wrapper 110, containing product 100 is to be placed within boxing 120 for further protection of wrapper 110 such that the possibility of wrapper 110 being torn or perforated is substantially reduced.

FIG. 3B is a sequential illustrated side view of product 100 of FIG. 2A, in wrapper 110, having been individually disposed within boxing 120, in one embodiment of the present invention. It should be appreciated that a product may or may not need to be individually boxed before packaging, as described above. The manufacturer of the product and/or the product reseller should determine whether the product would be better served if pre-boxed before packaging. However, it should be appreciated that the present invention will work equally well with products that are pre-boxed or not boxed.

Figure 3C:
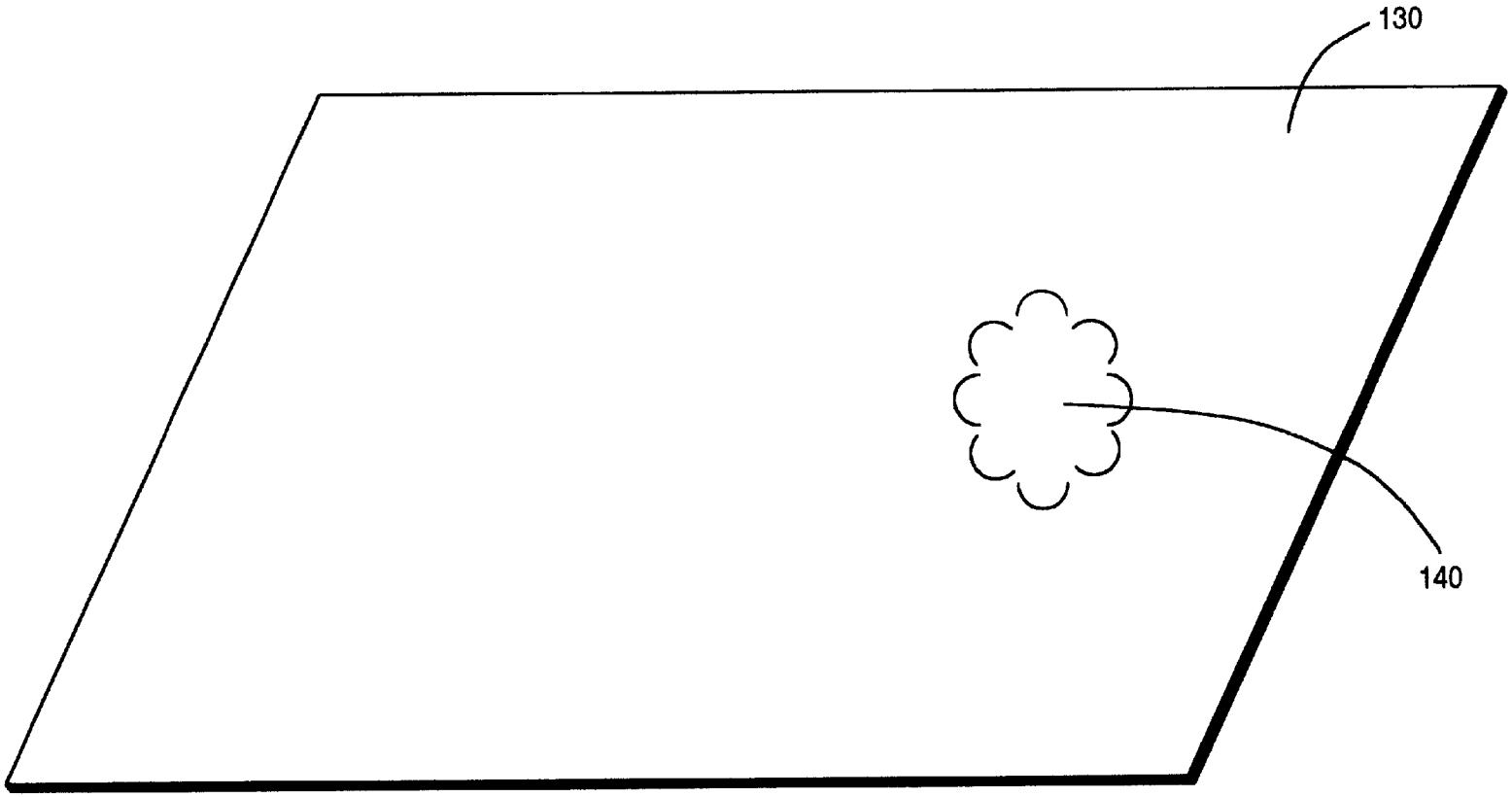
FIG. 3C is an illustrated view of a backing member, upon which the product in FIG. 3B is to be disposed, in accordance with one embodiment of the present invention.

FIG. 3C is an illustrated side view perspective of a backing member 130 upon which boxing 120, containing product 100 which is in wrapper 110, will be disposed, in one embodiment of the present invention. Backing member 130 is shown in a horizontal orientation. Adhering material 140 is shown as disposed upon backing member 130 and is for adhering product 100, whether or not in boxing 120, to backing member 130. When boxing 120, containing wrapper 110 which contains product 100, is properly disposed upon backing member 130, adhering material 140 is interposed between boxing 120 and backing member 130.

Figure 3D:
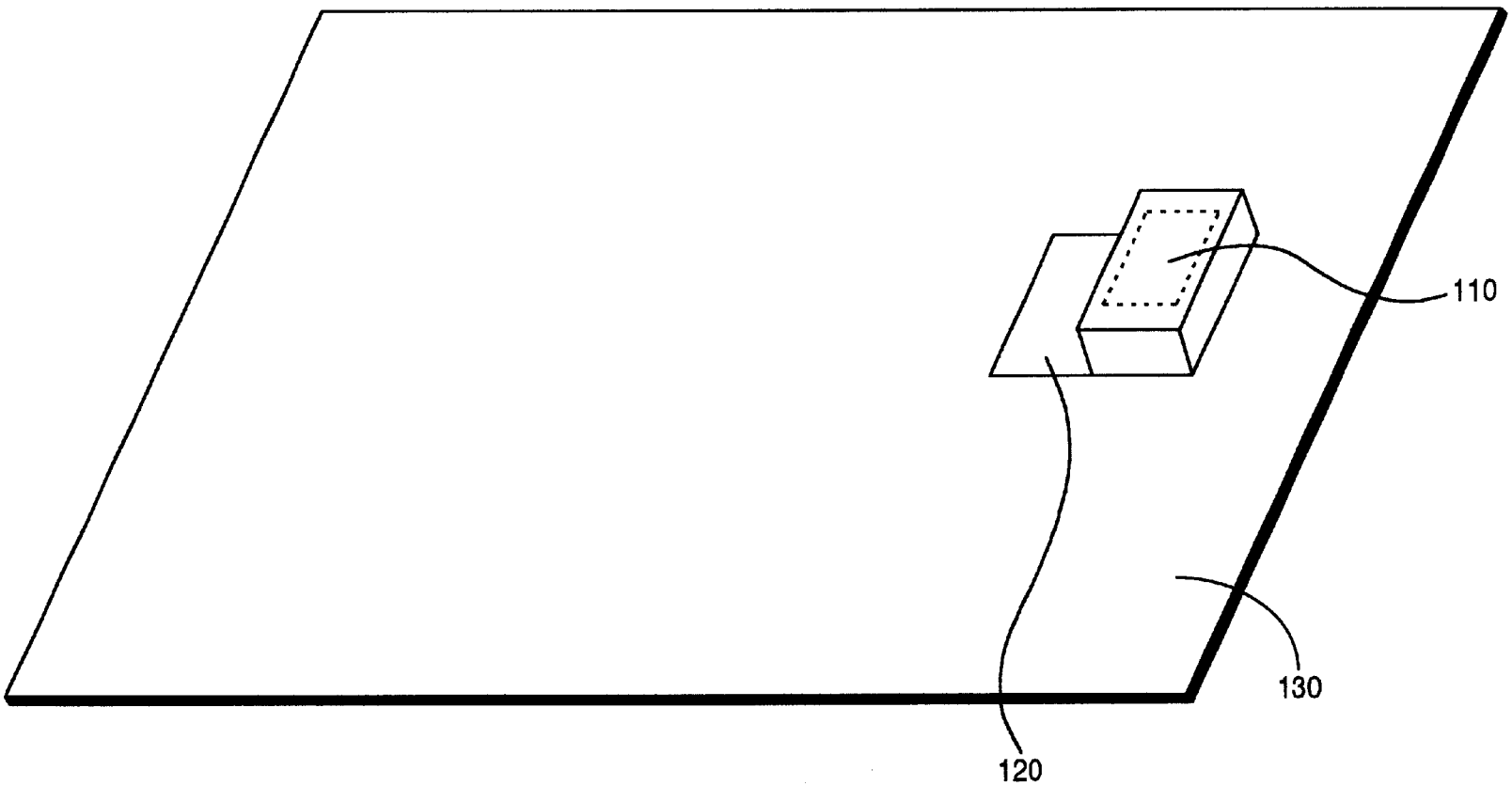
FIG. 3D is an illustrated view of the product of FIG. 3B disposed upon the backing member of FIG. 3C, in accordance with one embodiment of the present invention.

It should be appreciated that adhering product 140 of FIG. 3C, and FIG. 3D which follows, is analogous to the adhering product 140 as described in FIGS. 2C and 2D.

Still referring to FIG. 3C,, by utilizing a non-permanent glue as adhering material 140, in one embodiment, the possibility of damage to product 100, boxing 120, and backing member 130 is substantially reduced.

FIG. 3D is a sequential illustrated side view of wrapper 110, containing product 100, as having been properly disposed upon backing member 130, such that adhering material 140 is interposed between product 100 and backing member 130. After the proper placing of product 100, with or without boxing 120, upon backing member 130, with product 100 being adhesively attached, backing member 130 is then placed into a loading magazine 150, as seen in FIG. 4A, in preparation for packaging, in accordance with one embodiment of the present invention.

It should be appreciated that product 100, as described in FIGS. 2A–2D and 3A–3D may be unwrapped and unboxed or product 100 can be in a wrapper 110, in a boxing 120, or in a wrapper 110 which is in a boxing 120, or in combinations thereof. Accordingly, in describing the forthcoming figures, FIGS. 4A, 4B, and 5A, 5B, and 5C, the term product 100 may include just product 100, but may also refer to wrapper 110 and boxing 120, or a combination thereof.

Referring to backing member 130 of FIGS. 2C, 2D, 3C, and 3D, it should be appreciated that in one example, backing member 130 is constructed out of recyclable wood pulp products such as, e.g., a paper board or corrugated paper. In another example, backing member 130 is constructed out of a recyclable plastic material. In yet another example, backing member 130 is made of a combination of recyclable plastic and paper based materials. In yet another embodiment, metallic materials may be introduced as part of the backing member and/or combined with other materials, providing additional stiffing properties. In fact, nearly any material having relatively rigid properties may be utilized in the construction of backing member 130. It should be further appreciated that, in one embodiment, backing member 130 is preferably constructed from a material which is readily recyclable.

FIG. 4A is a sequential illustrated side-angled view of packaging system 2001, in one embodiment of the present invention. Shown is loading magazine 150 which now contains backing member 130 having product 100 attached thereto, as shown in FIGS. 2C, 2D, 3C, and 3D. Shown is flexible plastic material 160 which is adapted to encase backing 130 and product 100 in a sealed package.

It should be appreciated that in one embodiment, flexible plastic material 160 is transparent such that backing member 130 and product 100 are visible. In another embodiment, flexible plastic material 160 is opaque such that backing member 130 and product 100 are hidden. In another embodiment, flexible plastic material 160 has one portion that is transparent, such that some or all of product 100 may be visible. In the same embodiment, flexible plastic material 160 has another portion that is opaque, such that some or all of product 100 and/or backing member 130 is hidden.

Still referring to FIG. 4A, it should also be appreciated that, in the present embodiment, flexible plastic material 160 is adapted to receive marketing communication materials and graphics/artwork. Marketing and communication materials (commonly referred to as MARCOM materials) and graphic/artwork are the graphics and text that are present on most packaged products marketed today. For example, marketing communication materials and graphics/artwork can include such things as product logos, product manufacturer logos, product name, product description, a picture of the product, instructions on using the product. Other examples of marketing communication materials and graphics/artwork are product weight, product size, product item number, UPC bar code, contact information regarding the manufacturer of the product, and the like. It should further be appreciated that in the present embodiment, backing member 130, boxing 120, wrapper 110, and product 100 may be adapted to receive marketing communication materials and graphics/artwork.

It should also be appreciated that the flexible plastic material is configured to utilize standard eye marks for providing a postive registration so that correct package sealing and correct package cutting is enabled.

Continuing with FIG. 4A, flexible plastic material 160 is fed to a forming component 162. Forming component 162 is adapted to form flexible plastic material 160 into a partially constructed package. This partial package has a predetermined size relative to backing member 130 and product 100, shown as dimensions 170H and 170W. In the present embodiment, backing member 130 has dimensions of twelve and one half inches high and nine and one half inches wide. Accordingly, forming component 162 is, in this embodiment of the present invention, configured to provide a partially sealed package having dimensions of thirteen inches in height and ten inched in width. It should be appreciated that forming component 162 is configurable for nearly any size of package that may be required. Because of forming component 162, the partially formed flexible plastic material 160 is therefore enabled to receive backing member 130 and adhered product 100 from loading magazine 150. Sealing components 163A and 163B seal flexible plastic material 160 such that backing member 130 and adhered product 100 are packaged.

It should be appreciated that, in one embodiment of the present invention, a vacuum forming component may be utilized, during sealing, to vacuum-form flexible plastic material 160 around backing member 130 and product 100. This vacuum-forming provides a tighter packaging which can have an advantageous effect on the required shipping volume and associated costs. It should also be appreciated that the present invention can work equally well without benefit of vacuum-forming.

Laser engraver 164 provides additional printing functionality to packaging system by printing the date of packaging and packaging company and manufacturing information.

Figure 4B:
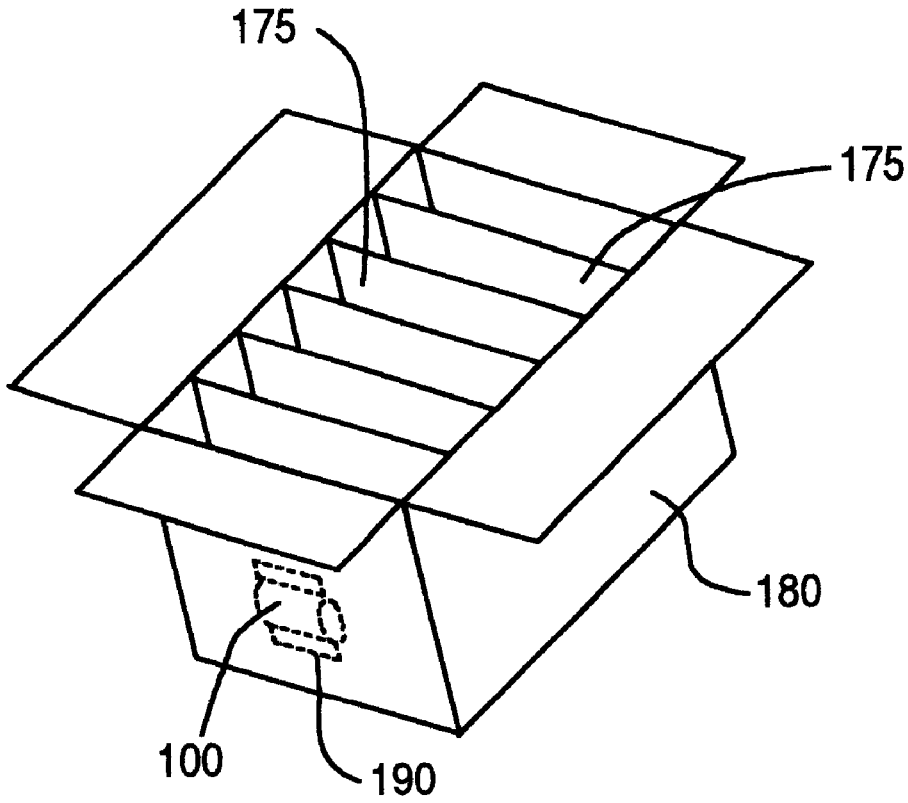
FIG. 4B is an illustrated view of the product and backing member subsequent to the completion of the packaging process and disposed within a shipping container, in accordance with one embodiment of the present invention.

FIG. 4B shows shipping container 180 with multiple finished packages 175 disposed therein. Product 100 is shown as disposed on the most forward facing finished package 175, as indicated by dashed line 190. It should be appreciated that, in the present embodiment, a single product 100 has been packaged utilizing packaging system 2001. However, in another embodiment, multiple product 100*s* may be disposed within finished package 175.

Figure 5A:
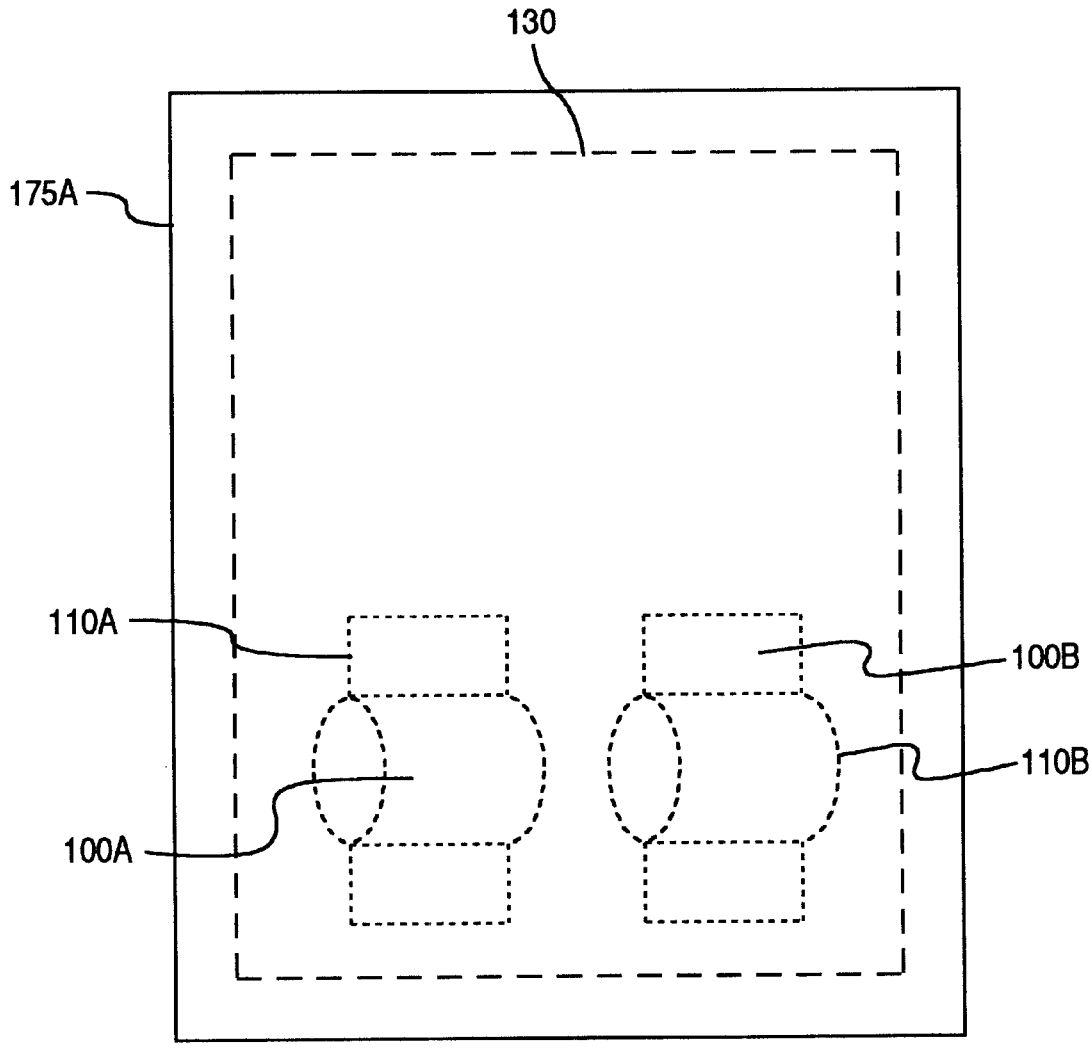
FIG. 5A is an illustrated view of multiple instancing of the product in FIGS. 2A and 3A disposed upon the backing member of FIGS. 2C and 3C, in accordance with one embodiment of the present invention.

FIG. 5A shows, in one embodiment, multiple instancings of product 100 being disposed within finished package 175. Backing member 130 is shown as contained within finished package 175. A first product 100A disposed within wrapper 110A is shown as disposed on the bottom left of backing member 130. A second product 110B disposed within wrapper 100B is shown on the bottom right of backing member 130. By disposing multiple instancings of product 100 upon backing member 130, the amount of product which can be shipped in a shipping container 180 is theoretically doubled, in comparison with the configuration of product 100 within shipping container 180 as shown in FIG. 4B. As such, a substantial savings in packaging, shipping and packaging materials used and costs thereof could be realized.

Figure 5B:
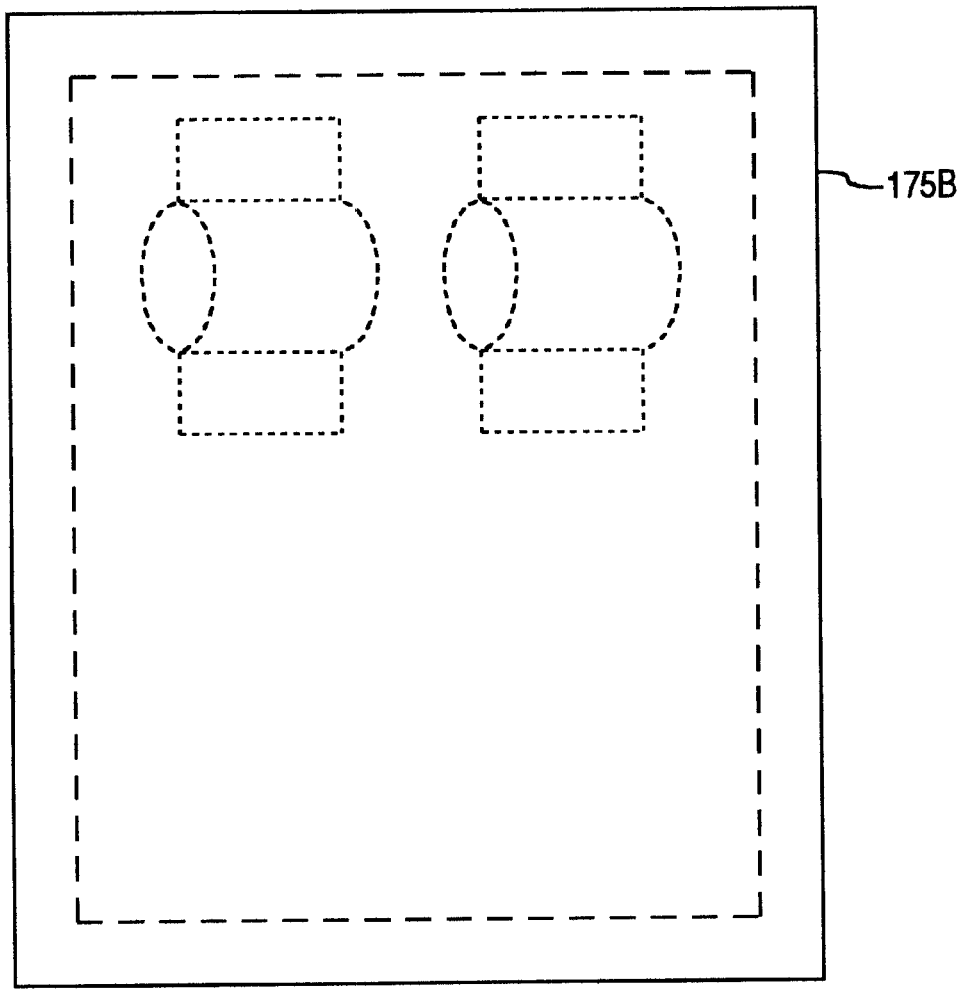
FIG. 5B is an inverted illustrated view of FIG. 5A, depicting an orientation of the multiple instanced product disposed upon a backing member, in preparation for shipping, in accordance with one embodiment of the present invention.

FIG. 5B shows finished package 175A of FIG. 5A in an inverted state, 175B. Finished package 175B is analogous to finished package 175A of FIG. 5A. When finished package 175A of FIG. 5A (normal orientation) and finished package 175B of FIG. 5B (inverted orientation) are combined, in preparation for distribution, the result is shown in FIG. 5C, in one embodiment of the present invention.

Figure 5C:
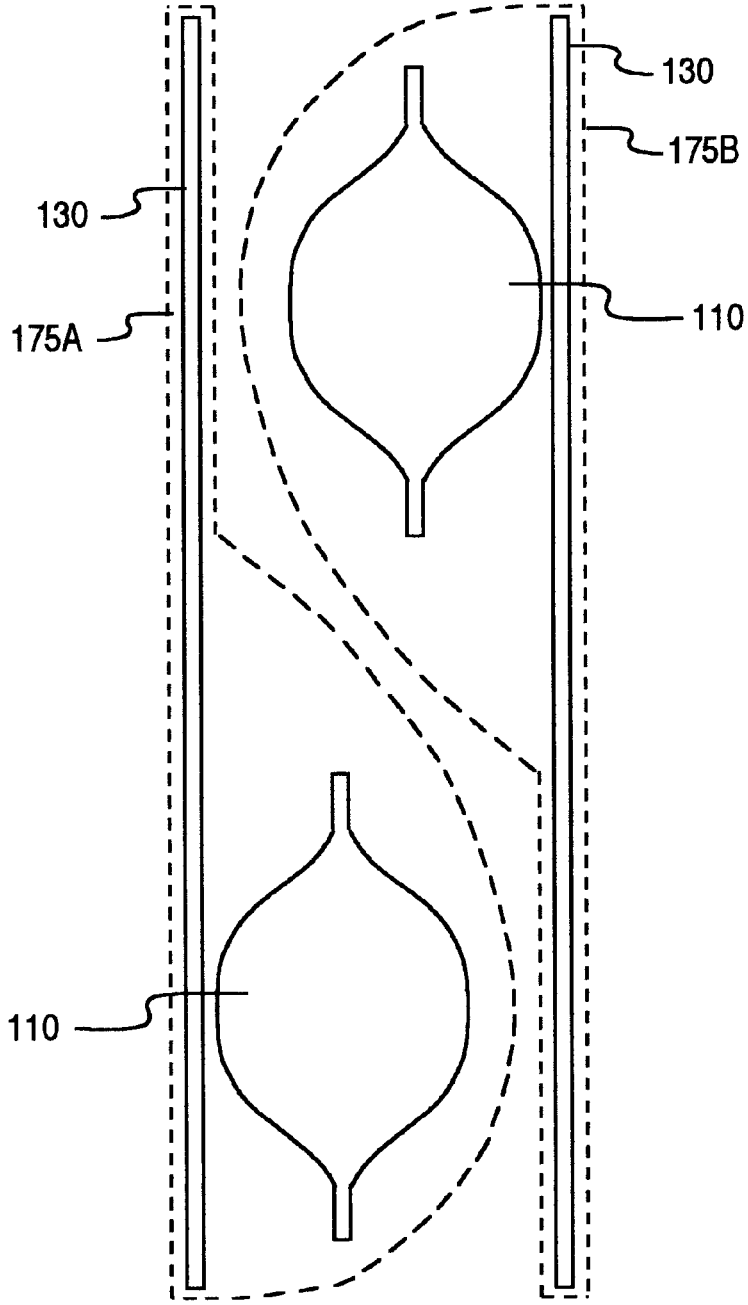
FIG. 5C is an illustrated view depicting the product and backing member of FIG. 5A and FIG. 5B in a combined orientation for shipping, in accordance with one embodiment of the present invention.

FIG. 5C shows one example of a multi-package configuration facilitated by packaging system 2001. To the left is an illustrated side view perspective of finished package 175A of FIG. 5*a*. To the right is an illustrated side view perspective of finished package 175B. It should be appreciated that by virtue of the side angle view, both instancings of product 100 on 175*a* and 175B are not visible. Because 175B is inverted relative to 175A, nearly double the number of products may be disposed within shipping container 180 in comparison with a shipping container 180 as described in FIG. 5A. Furthermore, nearly quadruple the number products may be disposed within a shipping container 180 as compared to the shipping container 180 as shown in FIG. 4B. Accordingly, by employing the type of packaging configuration for distribution, an even greater savings in packaging, shipping and packaging materials used and costs thereof could be realized, as compared to FIG. 5A.

Figure 6:
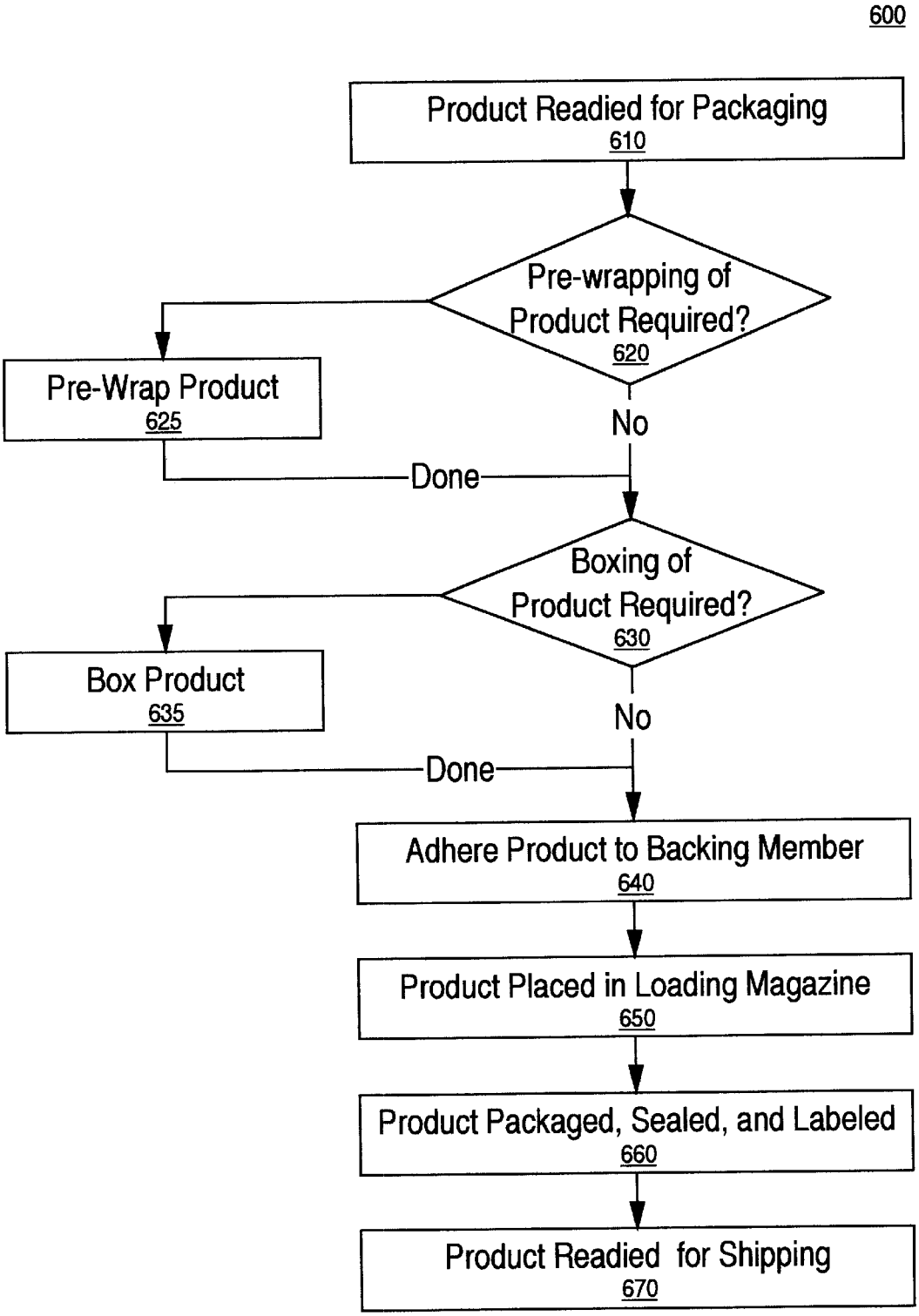
FIG. 6 is a flowchart showing steps in a process for product packaging, in accordance with one embodiment of the present invention.

FIG. 6 depicts a flowchart which illustrates steps in a process 600 for the utilization of packaging system 2001, in accordance with one embodiment of the present invention. In this embodiment, process 600 is implemented by the utilization of a packaging apparatus system commercially and readily available, such as one manufactured and sold by Mahaffey & Harder Engineering Company of Fairfield, N.J., or one manufactured and sold by Rovema Packaging Machines of Lawrenceville, Ga., or one from Iman Pack Sigma System Inc. of Westland, Miss. American Packaging Corporation of Rochester, N.Y. However, it is appreciated that some aspects of process 600 may be implemented on one packaging apparatus, with other aspects of process 600 performed on another. For example, the initial adhering of the product to backing member (as described in FIGS. 2A–2D, and 3A–3D) may be performed by one packaging apparatus, while the packaging, sealing, and readying for shipping (as described in FIGS. 4A, 4B, 5A–5C) may be performed on another. It is further appreciated that the steps in process 600 may be performed in an order different from that described In step 610 of FIG. 6, product 100, as shown in FIG. 2A, is ready for packaging. This means that the fabrication or manufacturing of product 100 has been completed and accordingly, product 100 is a finished product.

In step 620 of FIG. 6, the pre-wrapping of product 100, as described in FIG. 2B is performed, in one embodiment of the present invention. The pre-wrapping is done in step 625, and prior to the packaging of product 100. In another embodiment, product 100 may not need pre-wrapping.

In step 630 of FIG. 6, the pre-boxing of product 100, as described in FIG. 3B is performed, in one embodiment of the present invention. The pre-boxing is done in step 635, and prior to the packaging of product 100. In another embodiment, product 100 may not need pre-boxing.

In step 640 of FIG. 6, product 100, whether pre-wrapped in accordance with FIG. 2B or pre-wrapped and pre-boxed in accordance with FIG. 3B, or without pre-wrapping but pre-boxed, or neither pre-wrapped or pre-boxed, is adhereingly attached to a backing member 130, in one embodiment of the present invention. An adhesive 140, as described in FIGS. 2C and 3C is utilized and interposed between product 100 and backing member 130 such that product 100 is adhesively attached to backing member 130.

In step 650 of FIG. 6, subsequent to the completion of step 640, product 100, being adhereingly attached to backing member 130, and backing member 130 are placed into a loading magazine 150, as described in FIG. 4A, in one embodiment of the present invention. Loading magazine 150 sends the product to the package forming component of the packaging apparatus for completion of the packaging.

In step 660 of FIG. 6, product 100 and backing member 130 are processed and packaged as described in FIG. 4A, in one embodiment of the present invention. Flexible plastic material 160 is fed into a forming component 162. It should be appreciated that in one embodiment, material 160 is opaque. In another embodiment, material 160 is translucent. In yet another embodiment, material 160 has portions which are opaque and other portions which are translucent. In the last embodiment, the translucent portion may be disposed such that product 100 may be visible. It should be further appreciated that flexible plastic material 150 may have previously received the appropriate marketing communication materials and graphics/artwork. In another embodiment, the packaging apparatus may be adapted to provide the means to apply the marketing communication materials and graphics/artwork during or subsequent to the packaging process.

Still referring to step 660 of FIG. 6, forming component 162 forms flexible plastic material 160 into a partially constructed package having a size and shape appropriate for the product being packaged. From its place in loading magazine 150, product 100 is then moved to be placed in the partially constructed package. The packaging apparatus then utilizes sealing components 163A and 163B to seal flexible packaging material 160 such that backing member 130 and adhered product 100 are encased in finished package 175.

It should be appreciated that in one embodiment of the present invention, a vacuum forming component of the packaging apparatus is utilized during the sealing process to vacuum-form flexible plastic material 160 around backing member 130 with adhered product 100. In another embodiment, no vacuum is applied during sealing.

Still referring to step 660 of FIG. 6, subsequent to the sealing of flexible plastic material 160, in one embodiment, a laser engraver 164 may be present to provide additional printing functionality to the packaging apparatus. Laser engraver 164 may provide printing of information relative to the product and packaging e.g., date of packaging, packaging company, and manufacturing information, and the like, onto finished package 175.

In step 670 of FIG. 6, finished package 175 is then readied for shipping, as shown in FIG. 4B. In one embodiment, finished packages 175 are oriented such that they are vertically disposed within shipping container 180. In another embodiment, finished packages 175 are oriented such that they are horizontally disposed within shipping container 180. In yet another embodiment, finished packages 175 are oriented such that they are disposed stacked one on top of the other within shipping container 180. In yet another embodiment, they may be oriented as shown in FIGS. 5A–5C.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A product packaging system comprising:

a backing member to which a product is adhereingly attached thereto;

an adhering material for adhering said product to said backing member, said adhering material disposed upon said backing member;

a flexible plastic material for entirely encasing said backing member and said product together, wherein said flexible plastic material is sealable and wherein said flexible plastic material is tear resistant;

wherein said flexible plastic material comprises a first portion that is opaque and a second portion that is transparent, wherein some of said product is visible through said second portion and wherein some of said backing member is hidden by said first portion when encased in said flexible plastic material; and a sealing component for sealing said flexible plastic material such that said product and said backing member are entirely encased in a package.

2. A product packaging system as recited in claim 1 wherein said adhering material is interposed between said product and said backing member.

3. The product packaging system as recited in claim 1 wherein said backing member is relatively stiff in nature, and wherein said backing member is constructed of a readily recyclable and disposable material.

4. The product packaging system as recited in claim 1 wherein said adhering material is a hot melted adhering material, and wherein said product is disposed upon said hot melted adhering material on said backing member prior to said hot melted adhering material hardening such that the adhesive properties of said hot melted adhering material are no longer present.

5. The product packaging system as recited in claim 1 wherein said adhering material is non-permanent glue, wherein said non-permanent glue is removable from said backing member and said product, and wherein said backing member and said product are undamaged when said non-permanent glue is removed.

6. The product packaging system as recited in claim 1 wherein said flexible plastic material is capable to receive laser engraving and marketing communication materials and graphics/artwork for displaying product manufacturing and marketing and communication information.

7. The product packaging system as recited in claim 1 wherein said flexible plastic material is capable to utilize standard eye marks for providing registration facilitating correct package sealing and correct package cutting.

8. The product packaging system as recited in claim 1 wherein when said flexible plastic material is transparent such that said product and said backing member are visible when encased by said flexible plastic material, and wherein when said flexible plastic material is opaque said product and said backing member are hidden from view when encased by said flexible plastic material.

* * * * *